US005915528A

United States Patent [19]

Shmuelov

[11] Patent Number: 5,915,528

[45] Date of Patent: Jun. 29, 1999

[54] PROTECTIVE STRIPE ASSEMBLIES WITH CONCAVE-CONVEX INTERFACES

[76] Inventor: Elyahu Shmuelov, 22 Narkisim, Kiryat Tivok 36000, Israel

[21] Appl. No.: 08/997,703

[22] Filed: Dec. 23, 1997

[51] Int. Cl.[6] ..... F41M 1/02

[52] U.S. Cl. ..... 2/2.5; 428/36.91; 428/911

[58] Field of Search ..... 2/2.5, 102; 428/911, 428/902, 35.9, 36.1, 36.91, 102

[56] References Cited

U.S. PATENT DOCUMENTS

| | | | |
|---|---|---|---|
| 3,431,818 | 3/1969 | King | 89/36 |
| 3,559,210 | 2/1971 | Hansen | 428/911 |
| 3,829,899 | 8/1974 | Davis | 2/2.5 |
| 4,179,979 | 12/1979 | Cook et al. . | |
| 4,198,707 | 4/1980 | Haupt et al. | 2/2.5 |
| 4,316,286 | 2/1982 | Klein . | |
| 4,483,020 | 11/1984 | Dunn . | |
| 4,559,251 | 12/1985 | Wachi . | |
| 4,633,528 | 1/1987 | Brandt | 2/2.5 |
| 4,989,266 | 2/1991 | Borgese et al. | 2/2.5 |
| 5,113,526 | 5/1992 | Wang et al. . | |
| 5,134,725 | 8/1992 | Yeshurun et al. . | |
| 5,316,820 | 5/1994 | Harpell et al. | 428/109 |
| 5,771,489 | 6/1998 | Snedeker | 2/12.5 |

*Primary Examiner*—John J. Calvert
*Assistant Examiner*—Tejash D Patel
*Attorney, Agent, or Firm*—Mark M. Friedman

[57] ABSTRACT

A protective assembly, which can be used as a protective garment, including a plurality of protective stripe assemblies being connected to one another to form a protective surface, each one of the plurality of protective stripe assemblies including a plurality of protective elements being aligned stripewise adjacent one another, the protective elements being shaped and arranged such that a concave-convex interface is formed between adjacent protective elements of a protective stripe assembly, rendering the protective surface flexible.

36 Claims, 2 Drawing Sheets

PROTECTIVE STRIPE ASSEMBLIES WITH CONCAVE-CONVEX INTERFACES

FIELD AND BACKGROUND OF THE INVENTION

The present invention relates to a protective garments and, more particularly, to a protective garments worn by an individual to absorb the impact and stop a projectile from penetrating the body of the wearer Bulletproof protective garments or armor are well known for personal use by human beings to prevent a projectile from penetrating the body of an individual.

Such garments are typically made from a plurality of plates formed of metallic or other suitable material which are fastened together in some manner to fit around the body of the wearer and in particular his upper torso.

Examples of such known bulletproof garments include those disclosed in U.S. Pat. Nos. 3,787,449 and 3,829,899, both of which teach protective armor in the form of a vest made of sheets of heavy gauge material. A pocket is formed in the sheets to removably receive a metal insert plate to increase the protective capabilities of the armor. The insert plate is formed of a number of edge-to-edge aligned plates disposed in two vertically extending rows with the joints between the plates covered by a series of third plates. Such an arrangement makes the metal insert plate flexible enough to bend transversely to the plane of the joints so as to fit about the body of the wearer in a vertical plane.

Another form of bullet proof armor is shown in U.S. Pat. No. 2,723,214. This bulletproof armor construction comprises a plurality of alternating layers of rigid plates and elastic material. Each layer of plate is formed of a plurality of individual segments with joints between the segments offset from layer to layer.

These patents show that it is well known to form bulletproof armor with flexible plates which flex or hinge to conform to the curvature of the torso of the wearer along one plane, i.e., up and down. However, problems still exist with their use as regarding the mobility of the individual wearing the bulletproof armor. The prior art uses rigid plates arranged for flexing or hinging along one plane so as to conform to the body of the wearer along that particular plane. However, the torso of a human being curves in both the vertical and horizontal planes. Thus, the provision of rigid plates that can flex along only one plane does nothing for conforming the shape of the bulletproof vest or armor to the shape of the human torso along the other plane, i.e., from side-to-side. The plates along this other plane are rigid and extend substantially straight along the vest which reduces the mobility of the individual wearing the protective garment since the garment does not closely conform to the shape of the human being along this plane. In addition, such a bulletproof armor construction fails to provide for a close fit for a wide variety of different sized wearers.

U.S. Pat. No. 4,316,286 discloses a bulletproof protective plate assembly suitable for use as bulletproof armor. The protective plate assembly includes a plurality of first plates arranged in vertical edge-to-edge relationship. The first plates are formed with contiguous first and second portions, with the second portion disposed at a predetermined angle with respect to the first portion, such that the first plates closely conform to the shape of the upper torso of a human being along the vertical plane when the protective plate assembly is applied thereto. One of the lateral edges of the second portion of certain of the first plates is notched or disposed at an obtuse angle with the corresponding contiguous edge of the first portion of the first plate so as to enable the first plates to flex or hinge about the adjoining vertical edges without the edges of the second portions of each plate abutting to thereby closely conform the protective plate assembly to the body of the wearer along the horizontal plane. A plurality of second plates are disposed over the joints between adjoining edges of the first plates. The first and second plates are contained in the desired position within an enclosure that is inserted into a cavity in a conventional bulletproof vest or can be used with an identically formed protective plate assembly and connecting straps to protect both the front and back of the wearer. It is evident from the above description and from the drawings accompany the above patent that the proposed solution confers great uncomfort upon a user since the protective plate assembly is not flexible.

Thus, it would be desirable to provide a protective assembly for individual use which overcomes the problems associated with prior art bulletproof protective garments and armor. It would also be desirable to provide a protective assembly which conforms to the shape of the upper torso of a human being along both the horizontal and vertical planes and which is flexible. Finally, it would be desirable to provide a protective assembly which does not hinder the movement of the wearer so as to provide increased mobility therefore.

SUMMARY OF THE INVENTION

According to the present invention there is provided a protective assembly, which can be used as a protective garment.

According to further features in preferred embodiments of the invention described below, the protective assembly comprising a plurality of protective stripe assemblies being connected to one another to form a protective surface, each one of the plurality of protective stripe assemblies including a plurality of protective elements being aligned stripewise adjacent one another, the protective elements being shaped and arranged such that a concave-convex interface is formed between adjacent protective elements of a protective stripe assembly, rendering the protective surface flexible.

According to still further features in the described preferred embodiments the concave-convex interface is formed by providing each of the plurality of protective elements concave on one end thereof and convex on the other end thereof and by arranging the protective elements head-to-tail, such that a concave end of one element engages a convex end of an adjacent element.

According to still further features in the described preferred embodiments the concave-convex interface is formed by providing some of the plurality of protective elements concave on both ends thereof and some of the plurality of protective elements convex on both ends thereof and by arranging the protective elements in an alternating arrangement, such that a concave end of one element engages a convex end of an adjacent element.

According to still further features in the described preferred embodiments the plurality of protective elements convex on both ends thereof have a different size compared to the plurality of protective elements concave on both ends thereof.

According to still further features in the described preferred embodiments the plurality of protective elements concave on both ends thereof are smaller in size compared to the plurality of protective elements convex on both ends thereof.

According to still further features in the described preferred embodiments the plurality of protective elements convex on both ends thereof are smaller in size compared to the plurality of protective elements concave on both ends thereof.

According to still further features in the described preferred embodiments each of the protective elements is formed with a tunnel passing from one end thereof to the other end and the plurality of protective elements are aligned stripewise adjacent one another via a wire inserted through the tunnels.

According to still further features in the described preferred embodiments each of the protective stripe assemblies includes a flexible sleeve within which the plurality of protective elements are aligned stripwise adjacent one another.

According to still further features in the described preferred embodiments each of the flexible sleeves is made of at least one layer of a ballistic fabric.

According to still further features in the described preferred embodiments the plurality of protective stripe assemblies are connected to one another via stitches.

According to still further features in the described preferred embodiments the plurality of protective stripe assemblies are connected to one another via stitches.

According to still further features in the described preferred embodiments each of the plurality of protective elements has a substantially planar configuration.

According to still further features in the described preferred embodiments each of the plurality of protective elements has a substantially cylindrical configuration.

According to still further features in the described preferred embodiments each of the plurality of protective elements is made of a ceramic material.

According to still further features in the described preferred embodiments each of the plurality of protective elements is made of metal.

According to still further features in the described preferred embodiments the metal is selected from the group consisting of aluminum and steel.

According to still further features in the described preferred embodiments each of the plurality of protective elements is made of plastic.

According to still further features in the described preferred embodiments each of the plurality of protective elements is made of glass.

According to still further features in the described preferred embodiments concave-convex interfaces formed between adjacent protective elements of a given stripe assembly are co-aligned with concave-convex interfaces formed between adjacent protective elements of an adjacent stripe assembly, such that the protective surface is pliable along the interfaces.

According to still further features in the described preferred embodiments each of the protective elements includes a core and a shell.

According to still further features in the described preferred embodiments the protective elements are shaped and arranged such that a protrusion-recession interlock is formed between adjacent protective elements of adjacent protective stripe assemblies.

The present invention successfully addresses the shortcomings of the presently known configurations by providing a protective assembly which is flexible and therefore comfortable to a wearer and which can be used to provide a bulletproof vest for protecting the torso of the wearer from the impact of projectiles.

BRIEF DESCRIPTION OF THE DRAWINGS

The invention herein described, by way of example only, with reference to the accompanying drawings, wherein.

DESCRIPTION OF THE PREFERRED EMBODIMENTS

Figure 1:
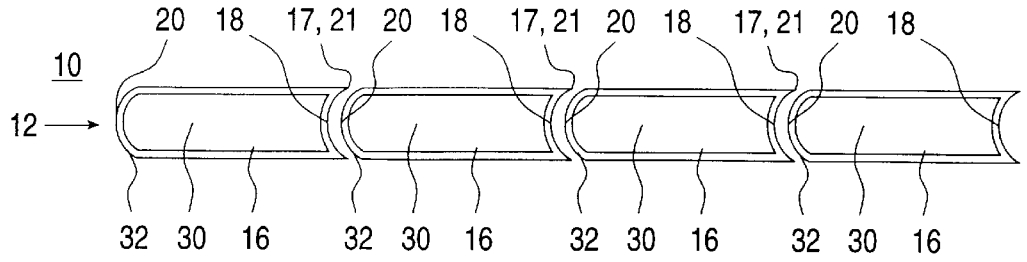
FIG. 1 is a cross sectional view of protective elements of a protective assembly according to one embodiment of the present invention.
Figure 2:
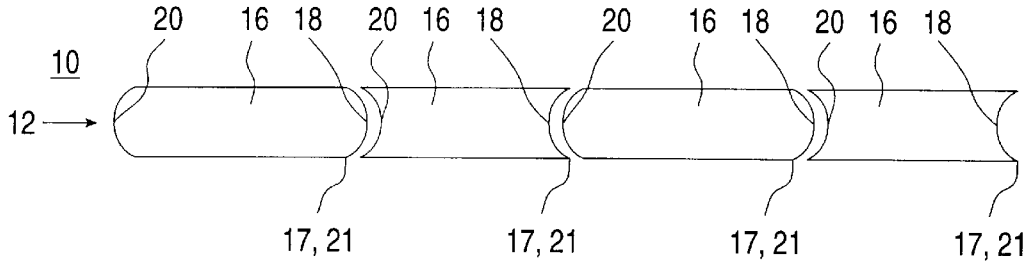
FIG. 2 is a cross sectional view of protective elements of a protective assembly according to another embodiment of the present invention.

The present invention is of a protective assembly which can be used as a protective garment or a part thereof. Specifically, the present invention can be used to provide a bulletproof vest which is flexible and therefore comfortable.

The principles and operation of a protective assembly according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIGS. 1–7 illustrate cross sections of few preferred embodiments of the protective assembly according to the present invention, which is referred to hereinbelow as protective assembly 10.

Figure 5:
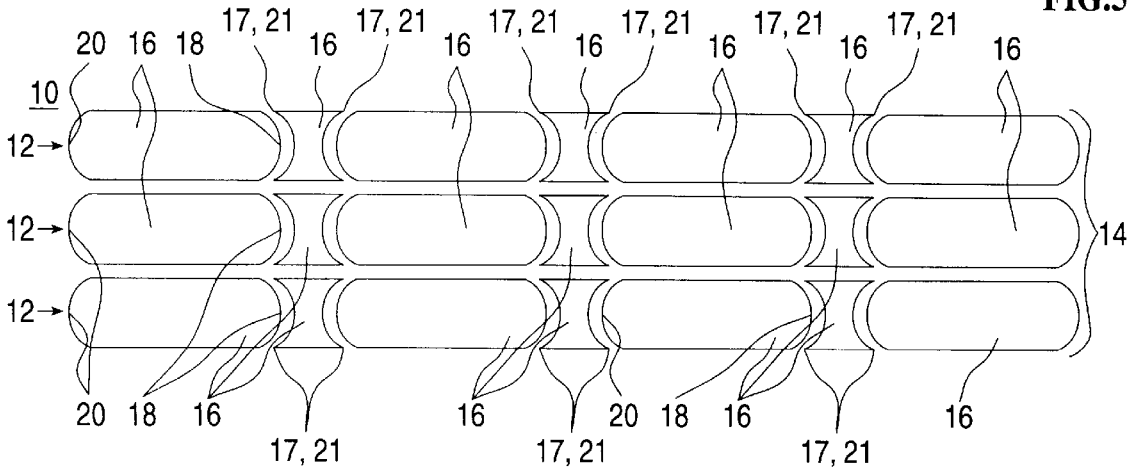
FIG. 5 is a cross sectional view of protective elements of a protective assembly according to the present invention arranged into a protective surface.

Thus, protective assembly 10, which can be used as a protective garment or surface, includes a plurality of protective stripe assemblies 12. As shown in FIG. 5, protective stripe assemblies 12 are connected to one another to form a protective surface 14. Typically several protective stripe assemblies 12 would be required to form a protective surface of a desired size.

Each one of protective stripe assemblies 12 includes a plurality of protective elements 16. Protective elements 16 are aligned stripewise adjacent one another to form stripe assemblies 12. Protective elements 16 are shaped and arranged such that a concave-convex interface 17 is formed between adjacent protective elements 16 of a protective stripe assembly 12. It will be appreciated that the shape and arrangement of protective elements 16 renders each section of stripe assemblies 12 flexible or pliable in two axes (X, Y and θ) in a snake-like fashion. Thereby protective surface 14 also becomes flexible and comfortable to a wearer.

As further shown in FIG. 5, according to a preferred embodiment of the invention concave-convex interfaces 17 formed between adjacent protective elements 16 of a given stripe assembly 12 are co-aligned with concave-convex interfaces 17 formed between adjacent protective elements 16 of an adjacent stripe assembly 12, such that protective surface 14 as a whole becomes pliable along interfaces 17.

According to another preferred embodiment of the invention, and as specifically shown in FIG. 1, each of concave-convex interface 17 is formed by providing each of protective elements 16 concave on one end 18 thereof and convex on the other end 20 thereof, and further by arranging protective elements 16 in a head-to-tail arrangement, such that a concave end 18 of one element engages a convex end 20 of an adjacent element.

According to an alternative embodiment of the present invention, and as specifically shown in FIGS. 2–6, each of concave-convex interfaces 17 is formed by providing some of protective elements 16 concave on both ends 18 and 20 thereof and some of protective elements 16 convex on both ends 18 and 20 thereof, and further by arranging protective elements 16 in an alternating arrangement, such that a concave end, say 18, of one element engages a convex end, say 20, of an adjacent element.

In all cases a narrow gap 21 is preferably formed between adjacent protective elements, to effect the pliability of protective stripe assemblies 12.

Figure 3:
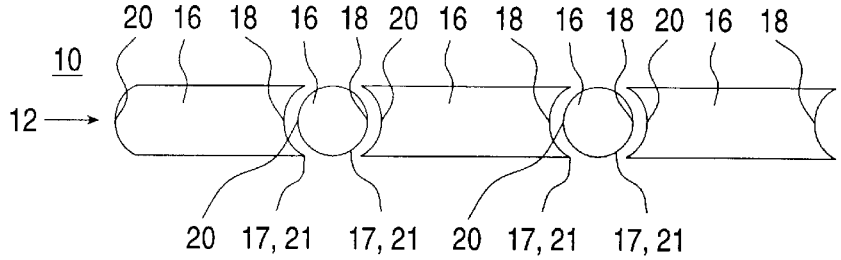
FIG. 3 is a cross sectional view of protective elements of a protective assembly according to still another embodiment of the present invention.
Figure 4:
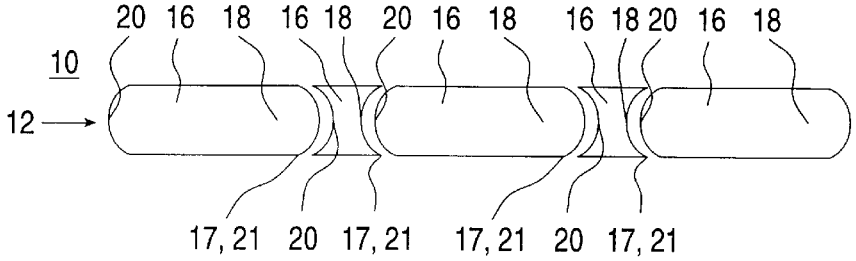
FIG. 4 is a cross sectional view of protective elements of a protective assembly according to yet another embodiment of the present invention.

According to another preferred embodiment of the present invention, and as specifically shown in FIGS. 3–5, protective elements 16 convex on both ends thereof have a different size compared to protective elements 16 concave on both ends thereof.

In FIG. 3 protective elements 16 convex on both ends thereof are smaller in size compared to plurality of protective elements 16 concave on both ends thereof, whereas in FIGS. 4 and 5 protective elements 16 concave on both ends thereof are smaller in size compared to plurality of protective elements 16 convex on both ends thereof.

Figure 6:
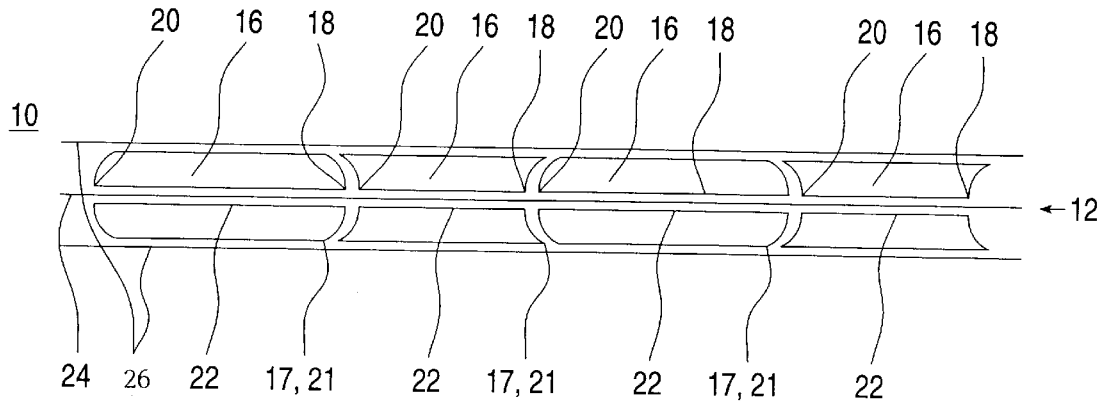
FIG. 6 is a cross sectional view of protective elements of a protective assembly according to the present invention arranged via wire or flexible sleeve in a stripewise fashion.

As shown in FIG. 6, according to a preferred embodiment of the present invention each of protective elements 16 is formed with a tunnel 22 passing from one end 18 thereof to the other end 20. According to this embodiment of the invention protective elements 16 are aligned stripewise adjacent one another via a wire 24 inserted through tunnels 22. Thus, according to this embodiments protective elements 16 are aligned stripewise like beads of a necklace. The term "wire" as used herein in the specification and in the claims section below refers also to a string, cable, band and the like.

As further shown in FIG. 6, according to an alternative embodiment, or in addition, each of protective stripe assemblies 12 includes a flexible sleeve 26 within which protective elements 16 are aligned stripewise adjacent one another. Each of flexible sleeves 26 is preferably made of at least one layer of a ballistic fabric. A suitable ballistic fabric is distributed by DuPont under the name KEVLAR. Independent sleeves 26 may be connected to one another via stitches, ad well known in the art, to form protective surface 14, shown in FIG. 5. According to a preferred embodiment of the invention each of sleeves 26 includes a first layer of a flexible material (e.g., rubber) attached, e.g., glued, to protective elements 16 and a second layer of a ballistic fabric. The rubber layer, which is preferably slightly stretched, ensures that protective elements 16 remain adjacent one another in a necklace-like fashion, whereas the ballistic fabric protects against disintegration following impact by a projectile.

According to one embodiment of the present invention each of protective elements 16 has a substantially planar dorsal-ventral configuration. According to another embodiment, each of protective elements 16 has a substantially cylindrical dorsal-ventral configuration. In any case small protective elements 16, as, for example, shown in FIG. 3, may acquire a spherical or ball shape.

Protective elements 16 are made of a hard or taught material such that protective assembly 10 is rendered bulletproof. For example, protective elements 16 may be made of a ceramic material, metal, such as aluminum or steel, hardened plastic or glass.

As shown specifically in FIG. 1, according to a preferred embodiment of the present invention each of protective elements 16 includes a core 30, made, for example, from a ceramic material, and a shell (cover) 32, made, for example, from metal.

Figure 7:
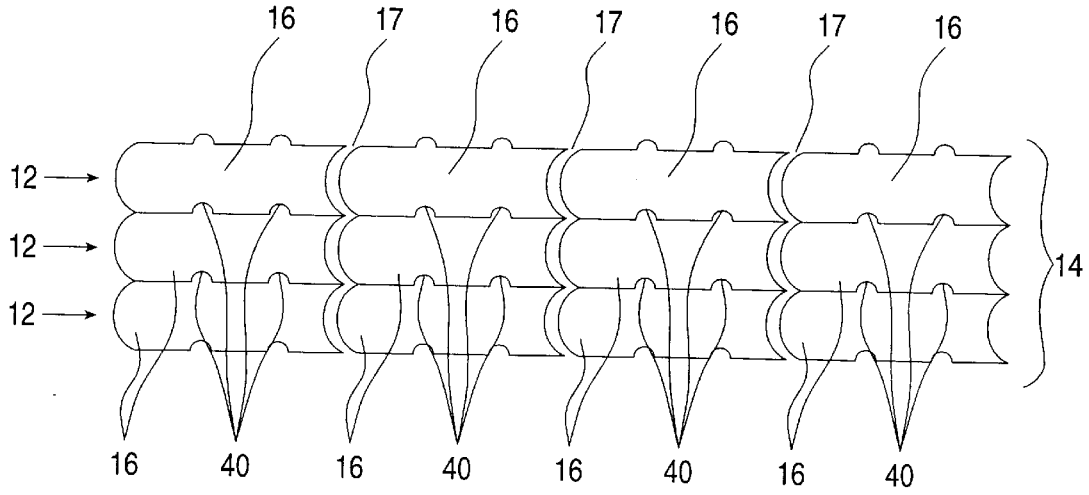
FIG. 7 is a cross sectional view of protective elements of a protective assembly according to the present invention including protrusion-recession interlocks therebetween.

FIG. 7 shows another embodiment of the present invention. According to this embodiment protective elements 16 are shaped and arranged such that at least one (two are shown) protrusion-recession interlock 40 is formed between adjacent protective elements 16 of adjacent protective stripe assemblies 12. According to this embodiment flexibility is achieved only along lines of interfaces 17.

The protective assembly according to the present invention is flexible and therefore comfortable to a wearer. The assembly can be used to provide a bulletproof vest for protecting the torso of a wearer from the impact of projectiles. The bulletproof vest may include, in addition to the protective assembly, layers of ballistic fabric. Being flexible, the protective assembly according to the present invention may also be used to provide a protective flexible surface for protecting various devices, including vehicles, etc.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A protective assembly, which is used as a protective garment and a protective surface, comprising a plurality of protective stripe assemblies being connected to one another to form a protective surface, each one of said plurality of protective stripe assemblies including a plurality of protective elements being aligned stripewise adjacent one another, said protective elements being shaped and arranged such that a concave-convex interface is formed between adjacent protective elements of a protective stripe assembly, rendering said protective surface flexible, wherein each of said protective elements is formed with a tunnel passing from one end thereof to the other end and said plurality of protective elements are aligned stripewise adjacent one another via a wire inserted through said tunnels.

2. The protective assembly of claim 1, wherein said concave-convex interface is formed by providing each of said plurality of protective elements concave on one end thereof and convex on the other end thereof and by arranging said protective elements head-to-tail, such that a concave end of one element engages a convex end of an adjacent element.

3. The protective assembly of claim 1, wherein said concave-convex interface is formed by providing some of said plurality of protective elements concave on both ends thereof and some of said plurality of protective elements convex on both ends thereof and by arranging said protective elements in an alternating arrangement, such that a concave end of one element engages a convex end of an adjacent element.

4. The protective assembly of claim 3, wherein said plurality of protective elements convex on both ends thereof have a different size compared to said plurality of protective elements concave on both ends thereof.

5. The protective assembly of claim 4, wherein said plurality of protective elements concave on both ends thereof are smaller in size compared to said plurality of protective elements convex on both ends thereof.

6. The protective assembly of claim 4, wherein said plurality of protective elements convex on both ends thereof are smaller in size compared to said plurality of protective elements concave on both ends thereof.

7. The protective assembly of claim 1, wherein each of said protective stripe assemblies includes a flexible sleeve within which said plurality of protective elements are aligned stripwise adjacent one another.

8. The protective assembly of claim 7, wherein each of said flexible sleeves is made of at least one layer of a ballistic fabric.

9. The protective assembly of claim 8, wherein said plurality of protective stripe assemblies are connected to one another via stitches.

10. The protective assembly of claim 1, wherein said plurality of protective stripe assemblies are connected to one another via stitches.

11. The protective assembly of claim 1, wherein each of said plurality of protective elements has a substantially planar configuration.

12. The protective assembly of claim 1, wherein each of said plurality of protective elements has a substantially cylindrical configuration.

13. The protective assembly of claim 1, wherein each of said plurality of protective elements is made of a ceramic material.

14. The protective assembly of claim 1, wherein each of said plurality of protective elements is made of metal.

15. The protective assembly of claim 14, wherein said metal is selected from the group consisting of aluminum and steel.

16. The protective assembly of claim 1, wherein each of said plurality of protective elements is made of plastic.

17. The protective assembly of claim 1, wherein each of said plurality of protective elements is made of glass.

18. The protective assembly of claim 1, wherein concave-convex interfaces formed between adjacent protective elements of a given stripe assembly are co-aligned with concave-convex interfaces formed between adjacent protective elements of an adjacent stripe assembly, such that said protective surface is pliable along said interfaces.

19. The protective assembly of claim 1, wherein each of said protective elements includes a core and a shell.

20. The protective assembly of claim 1, wherein said protective elements are shaped and arranged such that a protrusion-recession interlock is formed between adjacent protective elements of adjacent protective stripe assemblies.

21. A protective assembly, which is used as a protective garment and a protective surface, comprising a plurality of protective stripe assemblies being connected to one another to form a protective surface, each one of said plurality of protective stripe assemblies including a plurality of protective elements being aligned stripewise adjacent one another, said protective elements being shaped and arranged such that a concave-convex interface is formed between adjacent protective elements of a protective stripe assembly, rendering said protective surface flexible, wherein each of said protective elements includes a core made of a ceramic material and a shell made of metal.

22. The protective assembly of claim 21, wherein said concave-convex interface is formed by providing each of said plurality of protective elements concave on one end thereof and convex on the other end thereof and by arranging said protective elements head-to-tail, such that a concave end of one element engages a convex end of an adjacent element.

23. The protective assembly of claim 21, wherein said concave-convex interface is formed by providing some of said plurality of protective elements concave on both ends thereof and some of said plurality of protective elements convex on both ends thereof and by arranging said protective elements in an alternating arrangement, such that a concave end of one element engages a convex end of an adjacent element.

24. The protective assembly of claim 23, wherein said plurality of protective elements convex on both ends thereof have a different size compared to said plurality of protective elements concave on both ends thereof.

25. The protective assembly of claim 24, wherein said plurality of protective elements concave on both ends thereof are smaller in size compared to said plurality of protective elements convex on both ends thereof.

26. The protective assembly of claim 24, wherein said plurality of protective elements convex on both ends thereof are smaller in size compared to said plurality of protective elements concave on both ends thereof.

27. The protective assembly of claim 21, wherein each of said protective elements is formed with a tunnel passing from one end thereof to the other end and said plurality of protective elements are aligned stripewise adjacent one another via a wire inserted through said tunnels.

28. The protective assembly of claim 21, wherein each of said protective stripe assemblies includes a flexible sleeve within which said plurality of protective elements are aligned stripwise adjacent one another.

29. The protective assembly of claim 28, wherein each of said flexible sleeves is made of at least one layer of a ballistic fabric.

30. The protective assembly of claim 28, wherein said plurality of protective stripe assemblies are connected to one another via stitches.

31. The protective assembly of claim 21, wherein said plurality of protective stripe assemblies are connected to one another via stitches.

32. The protective assembly of claim 21, wherein each of said plurality of protective elements has a substantially planar configuration.

33. The protective assembly of claim 21, wherein each of said plurality of protective elements has a substantially cylindrical configuration.

34. The protective assembly of claim 1, wherein said metal is selected from the group consisting of aluminum and steel.

35. The protective assembly of claim 21, wherein concave-convex interfaces formed between adjacent protective elements of a given stripe assembly are co-aligned with concave-convex interfaces formed between adjacent protective elements of an adjacent stripe assembly, such that said protective surface is pliable along said interfaces.

36. The protective assembly of claim 21, wherein said protective elements are shaped and arranged such that a protrusion-recession interlock is formed between adjacent protective elements of adjacent protective stripe assemblies.

* * * * *